United States Patent [19]

Smith

[11] 3,995,517

[45] Dec. 7, 1976

[54] METHOD AND APPARATUS FOR OBTAINING DESIRED BATCH WEIGHT IN A SOLID SLICING CONTROL SYSTEM

[75] Inventor: Meredith E. Smith, Deerfield, Ill.

[73] Assignee: International Business Machines Corporation, Armonk, N.Y.

[22] Filed: Dec. 12, 1974

[21] Appl. No.: 531,954

[52] U.S. Cl. ..... 83/13; 83/73; 83/77; 83/367; 177/50; 177/121

[51] Int. Cl.[2] ..... B26D 1/06

[58] Field of Search ..... 198/39; 177/50, 121; 83/13, 73, 77, 360, 370, 371, 367

[56] References Cited

UNITED STATES PATENTS

| | | | |
|---|---|---|---|
| 3,099,304 | 7/1963 | Monsees et al. | 177/121 |
| 3,142,323 | 7/1964 | Metzler | 83/73 |
| 3,643,752 | 2/1972 | Blodgett | 177/50 X |
| 3,667,520 | 6/1972 | Flesch | 83/73 |

*Primary Examiner*—Leonidas Vlachos
*Assistant Examiner*—W. D. Bray
*Attorney, Agent, or Firm*—Jack M. Arnold

[57] ABSTRACT

A system for obtaining N slices of substantially uniform thickness from a solid to provide a batch having a desired weight, where N is an integer which may have a value between predefined limits. A partial batch weight is taken in response to weighing a number of slices less than N. A terminal value of N is estimated on the basis of the number of slices in the partial batch and the ratio of the desired batch weight and the partial batch weight. A predicted terminal deviation from the desired batch weight is calculated based on the partial batch weight and the ratio of the estimated value of N and the number of slices in the partial batch. In one embodiment the feed rate of the solid into a slicing device, and accordingly the slice thickness and terminal batch weight, is controlled as a function of the value of the predicted terminal deviation. In another embodiment the feed rate is fixed and the estimated value of N is modified as a function of the predicted terminal deviation for controlling the terminal batch weight.

16 Claims, 3 Drawing Figures

METHOD AND APPARATUS FOR OBTAINING DESIRED BATCH WEIGHT IN A SOLID SLICING CONTROL SYSTEM

BACKGROUND OF THE INVENTION

Generally, food packagers put more food in a package than is stated on the label in order to insure that the majority of containers contain at least the stated label weight. This is so, because of the relatively strict regulation of the food industry with respect to labeling practices. The excess of food in a package over and above that stated on the label is termed "give-away," Therefore, the consumer pays for a package having the stated label weight, but in reality normally receives somewhat more food.

Normally, the amount of give-away in a typical food package is nominal in terms of percentage of the label weight. It is to be appreciated, however, that over a period of a year the cost of such give-away for a given food producer is substantial. Therefore, the producer makes every effort to minimize the amount of give-away while maintaining a required percent of packages at a weight equal to or above the label weight within the packaging regulations of the government.

For sliced food packages, such as cheese and meat products, a rotating or reciprocating blade is used to slice cheese or meat having different forms such as loaves, bellies, hams, slabs of bacon and the like. After a predetermined number or all of the slices have been cut, the package is weighed and compared against a preset standard. An adjustment is made to the feed rate before cutting following slices. It is seen that the final weight of the sliced food package, for a given number of slices, is determined by the thickness of an individual slice, which is controlled by the rate at which the food is fed to the slicing mechanism.

Generally, in such a slicing system, the idea is to produce a package having a desired batch weight with substantially uniform slice thickness. This is difficult to achieve when slicing from a non-uniform or non-homogeneous loaf which varies significantly along its length in either density or dimension. Such non-uniform or non-homogeneous loaves, for example, are slabs of bacon, swiss cheese or the like. Since uniformity in slice thickness is more readily apparent to the consumer than uniformity of slice weight, unacceptable batches may be produced if the control system is set to achieve substantially uniform slice weight for a fixed number of slices.

In a control system for solid slicing as set forth in U.S. Pat. No. 3,508,591 of Johnson et al, which is assigned to the assignee of the present invention, a system is set forth for obtaining a preselected fixed number of slices of substantially uniform weight from a solid to provide a batch having a desired batch weight. The partial batch weight is measured after each slice is added and based on the number of slices and partial batch weight a predicted terminal error signal is calculated. The predicted terminal error signal is employed in one of a number of control algorithms and control effected to vary the feed rate of the solid into the slicing mechanism such that the thickness of each slice is regulated to obtain uniform slice weight, thereby minimizing deviation from the desired batch weight. Accordingly, there may be little uniformity in slice thickness when a non-uniform or non-homogeneous solid is sliced since an individual slice weight is determined by the density of the solid in the area being sliced.

According to the present invention, rather than trying to obtain a preselected fixed number of slices of substantially uniform slice weight from a solid to provide a desired batch weight, as is done in Johnson et al, the number of slices N for a given package is variable between high and low limits and a terminal value for N is estimated or predicted to obtain slices of uniform thickness for a desired batch weight. A terminal error signal for controlling the slicing mechanism is calculated based on the estimated value of N resulting in a package of uniform slice thickness and having a weight substantially equal to the desired batch weight.

SUMMARY OF THE INVENTION

According to the present invention, method and apparatus is set forth for providing a batch of N slices from a solid, where N may have a value between predetermined limits, with the total weight of the N slices being substantially equal to a desired batch weight. There is means for feeding the solid, at a selected velocity, into a slicing device which provides slices of a thickness controlled by the feed velocity. Also, there is means for obtaining a partial batch weight during the feeding by weighing a partial batch of less than N slices. Included is means for estimating the terminal value of N based on the number of slices in the partial batch and the ratio of the desired batch weight and the partial batch weight. Finally there is means for calculating a predicted terminal deviation from the desired batch weight based on the partial batch weight and the ratio of the estimated terminal value of N and the number of slices in the partial batch.

DESCRIPTION OF THE PREFERRED EMBODIMENT

The solid slicing control system of the present invention is illustrated in digital hardware form, however, it is to be appreciated that the present invention may also be practiced by the use of a properly programmed general purpose digital computer, or by suitable analog techniques.

Figure 1:
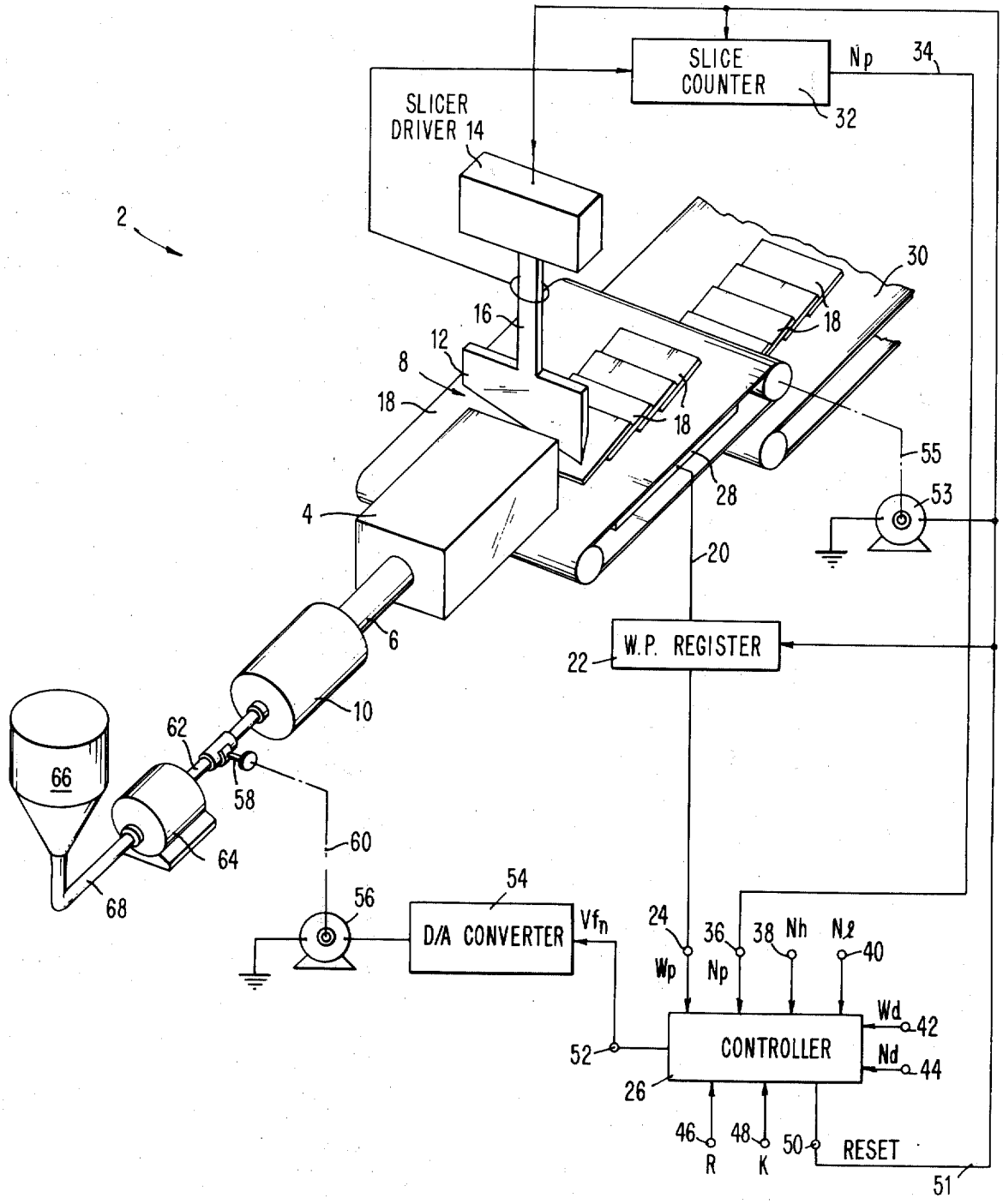
FIG. 1 is a schematic and block diagram representation of a solid slicing control system according to the present invention.

Refer to FIG. 1 which illustrates generally at 2 the solid slicing control system of the present invention. A solid 4 to be sliced is moved by means of a piston 6 into a slicing mechanism generally designated as 8. The piston 6 is caused to move by application of hydraulic fluid to a cylinder 10. For purposes of simplicity, the slicer 8 is illustrated as having a knife 12 which is moved reciprocally in a vertical direction. A slicer driver 14 is operative by means of shaft 16 to move the knife 12 in a vertical direction. Slices from the solid 4 fall onto a conveyer scale generally designated as 18 which is operative to provide, along a line 20, a signal indicative of the weight of the partial batch as each slice is added. This partial batch weight is stored in a register 22 which provides a digital partial weight signal $Wp$ to input terminal 24 of a controller 26. The conveyer scale 18 is further operative to transport slices 28 of solid 4 onto a conveyer 30 for subsequent packaging, once the controller 26 provides a reset signal which is indicative that the batch has the required number of slices.

A counter 32 is shown in operative association with the slicing means 12 and is operative to provide an indication along line 34 of the number of slices in a partial batch N*p* which have been deposited on the conveyer scale 18 at any given instant of time. The signal N*p* is applied to an input terminal 36 of the controller 26 for reasons to be explained more fully shortly. The controller 26 also receives input signals indicative of system parameters from either an operator, an appropriate look-up table, or read-only memory devices. Applied to input terminals 38 and 40 are a high weight reference signal, N*h*, and a low weight reference signal, N*l*, respectively. Applied to input terminals 42 and 44 are a desired weight signal, W*d*, and a desired number of slices for a batch, N*d*, respectively. Applied to input terminals 46 and 48 are a reference signal R, and a system operational constant K, respectively. A system reset signal is provided at an output terminal 50 for resetting register 22, counter 32 and slicer driver 14, by way of a line 51, once the final number of slices have been sliced. The reset signal is also applied to a steping motor 53 for causing the conveyor belt 18 to rotate a predetermined amount, by way of mechanical connection 55, for depositing the slices 28 on conveyor 30. The controller 26 responds to the provided input signals for providing a final velocity digital control signal, $Vf_n$, at an output terminal 52. A digital-to-analog (D/A) converter 54 responds to $Vf_n$ for providing an analog signal to a motor 56 which controls a hydraulic valve 58 by way of mechanical connection 60, such that the amount of fluid flowing through line 62 from hydraulic motor 64 to cylinder 10 is regulated by the controller 26. A reservoir of hydraulic fluid 66 is shown connected to hydraulic motor 64 along hydraulic line 68.

Figure 2:
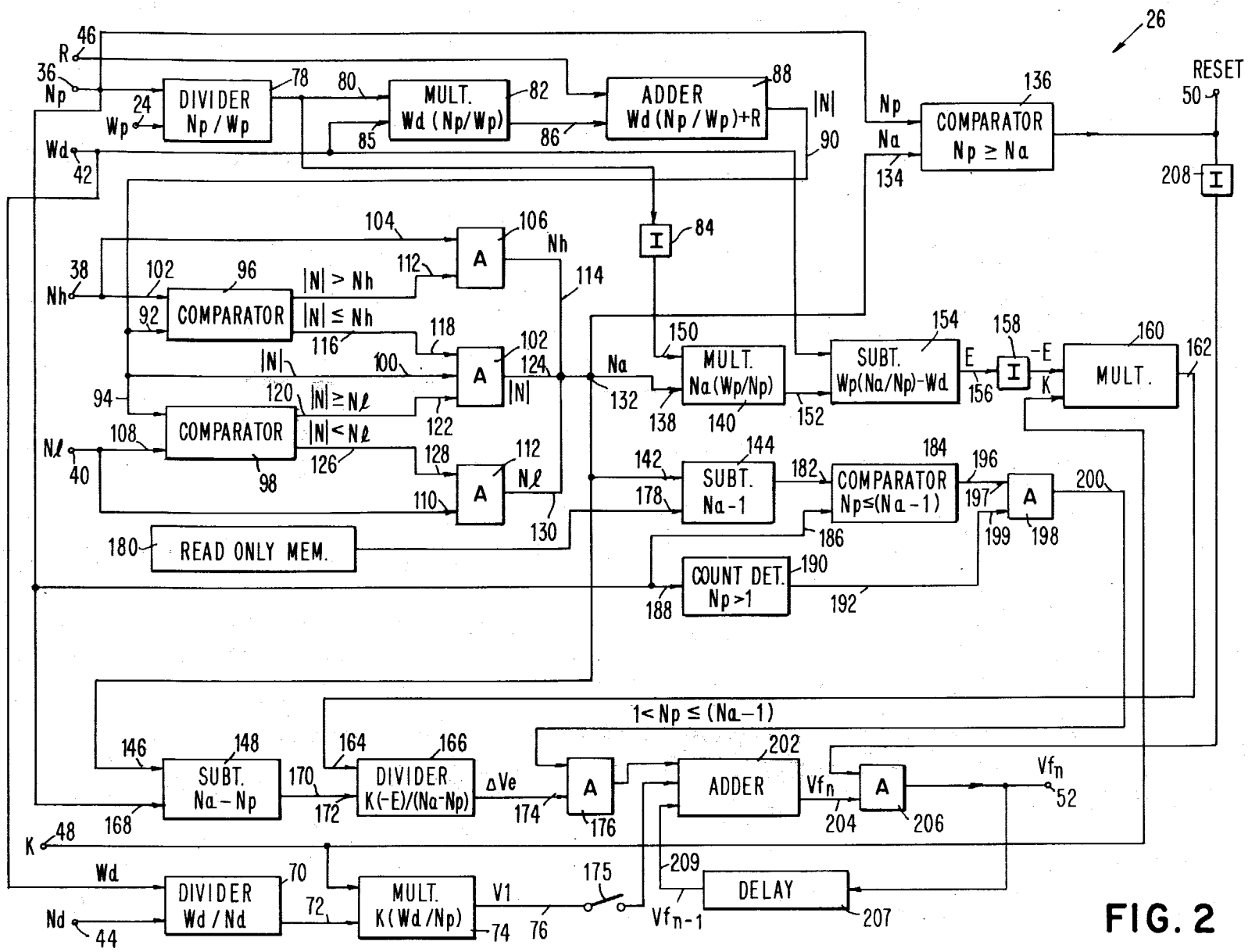
FIG. 2 is a block diagram representation of one embodiment of the controller of FIG. 1.

FIG. 2 illustrates one embodiment of the controller 26 of FIG. 1. The following equations are solved by the controller 26 for generating the feed velocity signal $Vf_n$ at the terminal 52 and the system reset signal at the terminal 50.

$$Vl = k(Wd/Nd) \quad (1)$$

where:

$Vl$ = Initial feed rate of a standard batch (in./min.).

$K$ = proportionality constant [(cuts/min.) (in/lb)].

Number of cuts are also related to blade revolutions.

If blade revolutions and feed rate are synchronized, $K$ = blade position (cut/lb/min.);

$Wd$ = batch weight desired (label weight);

$Nd$ = number of slices desired.

The slicer is then set to make a standard batch and after one or more slices (N*p*) a weight of the partial batch (W*p*) is taken. Several weights of partial batches are required for purposes of accuracy, as the final accuracy is dependent on the number of interations taken for a given batch. The number of iterations are restrained to $1 < Np \leq (Na-1)$. The number of slices $|N|$ in the terminal batch is then estimated from the partial batch data as set forth in the following equation.

$$|N| = Np(Wd/Wp) + R \quad (2)$$

where:

$|N|$ = whole number of slices (non-fractional) estimated for the terminal batch;

$Np$ = number of slices in a partial batch;

$Wd$ = batch weight desired (label weight);

$Wp$ = weight of partial batch of $Np$ slices;

$R$ = round off constant of normally 0.5.

The actual terminal value $Na$ of the number of slices in the terminal batch is determined as follows:

$$Na = |N| \text{ if } Nl \leq |N| \leq Nh \quad (3)$$

$$Na = Nl \text{ if } |N| < Nl \quad (4)$$

$$Na = Nh \text{ if } |N| > Nh \quad (5)$$

where:

$Na$ = actual number of slices in terminal batch;

$Nl$ = permissible low limit of number of slices in terminal batch;

$Nh$ = permissible high limit of number of slices in terminal batch.

The residual error E for the control system is then determined according to the following equation.

$$E = Wp(Na/Np) - Wd \quad (6)$$

where:

$E$ = estimate of over or underweight in the terminal batch;

$Wp$ = weight of partial batch of $Np$ slices.

$Na$ = actual number of slices in terminal batch according to which of equations (3) or (4) or (5) is satisfied.

$Np$ = number of slices in a partial batch.

$Wd$ = batch weight desired (label weight).

The required incremental change in feed rate or blade position ($\Delta Ve$) is calculated as follows:

$$\Delta Ve = (K)(-E)/(Na-Np) \quad (7)$$

where all of the symbols above have been defined above, and $$1 < Np \leq (Na-1) \quad (8)$$

that is there must be at least one slice on the scale, and no more than one less than the actual number of slices ($Na$) in the terminal batch on the scale, when $\Delta Ve$ is calculated.

The final feed rate $Vf_n$ of the solid into the slicer is calculated according to the following equation.

$$VF_n = Vl + \Delta Ve + Vf_{n-1} \quad (9)$$

where:

$Vf_n$ = final feed rate of the solid into the slicer;

$Vl$ = initial feed rate of standard batch according to equation (1) for system initialization;

$\Delta Ve$ = incremental change in feed rate according to equation (7).

$Vf_{n-1}$ = preceding feed rate of the solid into the slicer for the slicer preceding the slice presently being sliced.

A divider 70 takes the ratio of the desired weight signal, W*d*, as manifested at the terminal 42, and the desired number of slices, N*d*, as manifested at the terminal 44. This ratio signal is applied via a line 72 to a first input of a multiplier 74, which has applied to a second input the proportionality constant, K, from the input terminal 48. The signal appearing on the output line 76 from the multiplier 74 is the initial feed rate of a standard batch, V*l*, according to equation (1) and is used for system initialization.

A divider 78 takes the ratio of the number of slices in a partial batch, N*p*, and the weight of a partial batch, W*p*, as provided from the input terminals 36 and 24, respectively. The output signal from the divider 78 on a line 80 is applied to a first input of a multiplier 82 and the input of an inverter 84. It is seen that the signal appearing on the line 80 may change in value from one slicing interval to the next in accordance with the change in density of the solid being sliced. Applied to the second input terminal of the multiplier 82 via a line 85 is the desired weight signal, W*d*, from input terminal 42. The product signal appearing on the output line 86 of the multiplier 82 is applied to a first input of an adder 88 which adds the product signal with the roundoff constant R which is manifested at input terminal 46. The signal |N| appearing on the output line 90 from the adder 88 is the estimated number of slices for the terminal batch according to equation (2). It is assumed that the estimated value of |N| is normally correct within one-half a slice, which is accounted for by the roundoff constant R. The adder 88 functions such that, for each sum calculated, only the whole number portion thereof is manifested on line 90. For example, if the product signal appearing on the line 86 is a whole plus a fractional number of slices, such as 15.3 slices, the calculated sum of the adder 88 is 15.8 slices, resulting in an estimated value of |N| of the 15 on the output line 90. If the product signal appearing on the line 86 is 15.7 slices, this results in a calculated sum of 16.2 slices such that the estimated number of slice signal appearing on the line 90 is 16. The signal |N| appearing on the line 90 is applied to first inputs 92 and 94 of comparators 96 and 98, respectively, as well as to a first input 100 of an AND gate 102.

As previously explained, the estimated number of slices |N| is constrained to fall between predefined limits, namely a high limit of slices, N*h*, and a low limit of slices, N*l*. The reference signal N*h* appearing at the input terminal 38 is applied to a second input 102 of the comparator 96 and to a first input 104 of an AND gate 106. The reference signal N*l* appearing at input terminal 40 is applied to a first input 108 of the comparator 98 and to a first input 110 of an AND gate 112. Generally, for a 1 pound package of solid to be sliced, the number of slices desired is 16. Therefore, by way of example only, N*h* is chosen to be 18, the upper limit of slices, and N*l* to be 14, the lower limit of slices. If the estimated value of |N| is between and including 14 to 18 slices, the actual predicted value of the number of slices N*a* is equal to the estimated value of |N|. If the estimated valve of |N| is greater than 18, the actual number of slices N*a* is fixed at 18. If on the other hand the estimated number of slices |N| is less than 14, then the actual number of slices N*a* is fixed at 14. The comparator 96 compares the estimated value of |N| with the high limit of number of slices, N*h*. If N is greater than N*h*, a gating signal is provided on an output line 112, permitting the gate 106 to pass the signal, N*h*, to the output line 114 of the gate 106, thereby satisfying equation (5). If, on the other hand, the comparator 96 senses that N is less than or equal to N*h*, a gating signal is manifested on the output line 116 of the comparator, which signal is applied to a second input 118 of the AND gate 102. The comparator 98 compares the low limit reference signal, N*l*, with the estimated value of |N| signal, and whenever |N| is greater than or equal to N*l* a gating signal is manifested on the output line 120 from the comparator 98 which signal is applied to a third input terminal 122 of the gate 102. Since it is assumed that the gating signals appearing at the input terminals 118 and 122 are present, the gate 102 passes the estimated value of |N| signal to the output line 124, which indicates that equation (3) is satisfied. If on the other hand comparator 98 senses that the signal |N| is less than the signal N*l*, a gating signal is manifested on the output line 126 providing a gating signal to the second input 128 of the gate 112, thereby permitting the gate 112 to pass the signal N*l* appearing at the input terminal 110, which signal is then manifested on the output line 130, which is indicative that equation (4) has been satisfied. The actual number of slices to be cut in the terminal batch, that is signal N*a*, appearing at the terminal 132, is dependent upon which of the equations (3), (4), or (5) is satisfied as manifested by which of the gates 102, 112, or 106 is providing an output signal. It is seen that one and only one of the gates may provide an output signal at any given instant of time.

The signal N*a* is provided to a first input 134 of a comparator 136, a first input 138 of a multiplier 140, a first input 142 of a subtractor 144, and a first input 146 of a subtractor 148. The multiplier 140 has applied to a second terminal 150 by way of the inverter 84 a signal which is the ratio of the partial weight W*p* and the partial number of slices N*p*. The product signal manifested on an output line 152 of the multiplier 140 is provided to a first input of a subtractor 154 which subtracts the desired weight signal, W*d*, as manifested at the input terminal 42 from the product signal appearing on the line 152. The signal appearing on the output line 156 from the subtractor 154 is the error signal E according to equation (6). The error signal E is inverted by an inverter 158, for reasons to be explained shortly, for providing a signal −E to a first input of a multiplier 160, which has applied to the second input thereof, from the input terminal 48, the proportionality constant K. The product signal appearing on the output line 162 from the multiplier 160 is applied to a first input line 164 of a divider 166. The subtractor 148 has applied to a second input line 168 the signal N*p*, as manifested at the input terminal 36. The subtractor 148 provides the difference signal, N*a*−N*p*, on an output line 170, which signal is applied to the second input line 172 of the divider 166. The signal appearing on the output line 174 of the divider 166 is the incremental change in feed rate signal, ΔV*e*, according to equation (7). It may now be seen that the signal E appearing at the output of subtractor 154 is inverted such that the signal, ΔV*e*, properly compensates for the error detected by the subtractor 154. That is, if the signal E appearing on the line 156 is positive, the incremental signal ΔV*e* must change in a negative direction, and conversely, if the error signal E is negative, the incremental signal, ΔV*e*, must change in the positive direction.

The incremental signal ΔV*e* is applied to a first input of an AND gate 176, which has applied to a second input a gating signal which permits the incremental weight change signal, ΔV*e*, to be passed only when there is more than one slice on the conveyer scale 28 (FIG. 1) and there is no more than one less than the actual number of slices N*a* on the conveyer scale 28. This gating signal is present whenever equation (8)

$1 < Np \leq (Na-1)$ is satisfied. The determination of whether or not this equation is satisfied is accomplished according to the following logic. The subtractor 144 has applied to the second input line 178 thereof from a read-only memory 180 a signal indicative of the number 1. The subtractor 144 subtracts 1 from N*a* and applies this signal to a first input 182 of a comparator 184. Applied to a second input line 186 of the comparator 184 and a first input line 188 of a count detector 190 is the signal N*p* as manifested at the input terminal 36. The count detector 190, which in practice may be a gating network, provides a gating signal on an output line 192 whenever the partial slice count N*p* is greater than 1. The comparator 184 provides a gating signal on an output line 196 whenever the partial slice count N*p* is less than or equal to (N*a*−1). An AND gate 198 receives the signals from the comparator 184 and count detector 190 on input lines 197 and 199, respectively, and provides a gating signal on an output line 200 whenever there is more than one slice on the scale and there is one less than N*a* slices on the scale, with this gating signal being applied to the second input of the AND gate 176.

The initial velocity signal, V*l*, appearing on the line 76 is momentarily applied to a first input of an adder 178, by means of the momentary closure of a switch 175, with the output from the gate 176 being applied to the second input thereof. The adder 178 adds the incremental signal $\Delta Ve$ to the initial velocity signal V*l* for providing the feed velocity signal $Vf_n$ on a line 204 in accordance with equation (9). The feed velocity signal $Vf_n$ is applied to a first input of an AND gate 206 which has a gating signal applied to the second input thereof from inverting device 208. Whenever the gating signal is provided, $Vf_n$ is passed to output terminal 52 and the input of a delay network 207 which has a delay time substantially equal to the time required to slice one slice. Thereafter, the preceding feed velocity signal $Vf_n^{-}{}_1$ appearing on output line 209 of the delay network 207 is applied to a third input of the adder 202 for being summed with the signal $\Delta Ve$ for calculating succeeding values of the feed velocity signal, $Vf_n$.

The comparator 136 compares the signal N*p* and the signal N*a* and, in response to the comparison, provides a pulse output when N*p* is equal to or greater than N*a* which is indicative that the slicing cycle for a given package is complete. In other words, a reset pulse is provided at the terminal 50 whenever the number of slices on a conveyer scale 28 (FIG. 1) is equal to or greater than the computed actual number of slices N*a* for the terminal batch. As previously explained, the reset signal is provided to the stepping motor 51 for transferring the slices from the conveyer 18 to the conveyer 30, to the slice counter 32, the register 22 and the slicer driver 14 (FIG. 1) for resetting these devices to initiate a new slicing cycle. Whenever the reset signal is provided there is an inhibiting signal provided at the output of the inverter 208 which causes the gate 206 to be inhibited, thereby preventing the provision of the feed velocity signal, $Vf_n$, which in turn prevents further feeding of the solid 4 into the slicing mechanism. At all other times, a reset signal is not provided at the terminal 50, and accordingly the inverter 208 provides a gating signal at its output which enables the gate 206 to pass the signal $Vf_n$ such that the solid 4 is fed to the slicing mechanism.

Figure 3:
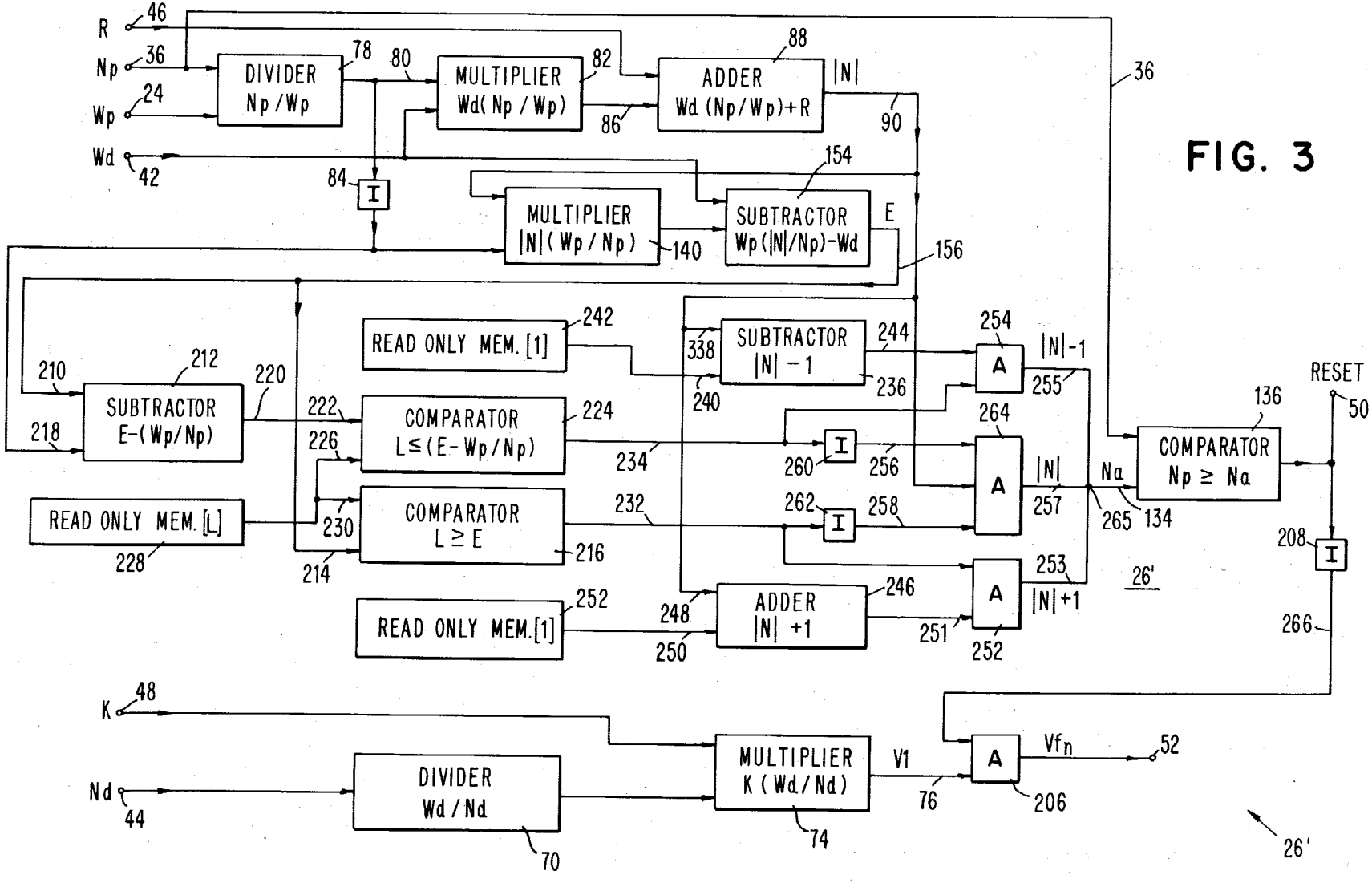
FIG. 3 is another embodiment of the controller illustrated in FIG. 1.

Refer now to FIG. 3 which illustrates a controller 26′ which may be used as the controller 26 of FIG. 1 when a solid is being sliced for commercial use. The elements of controller 26′ which are the same as those illustrated in FIG. 2 for the controller 26, retain their previous numerical designation. When a plurality of individual packages form a group of packages for commercial use, an individual package may be below the desired package weight if the total weight of all the packages in the group is equal to or above a desired group package weight. If the total group package weight is less than the desired group package weight, a package may be added to the group, or alternatively the customer pays based on the actual group package weight. Accordingly, a gross control of the terminal number of slices and feed velocity may be effected for a given package. The controller 26′ provides a fixed feed velocity signal, $Vf_n$, which is equal to the initial feed velocity, V*l*. Accordingly, it is seen that there is no incremental change in feed velocity to compensate for changes in the density of the loaf being sliced. As with the controller 26, the number of slices may vary between predefined limits; however, these limits are constrained to a fixed number, for example one slice above or one slice below the estimated number of slices $|N|$. It is to be appreciated, however, that fixed numbers other than one may be utilized. The actual number of slices, N*a*, for the terminal batch is not calculated or based on an upper or lower slice limit, but is calculated relative to a legal weight limit, L, and the previously defined error signal, E. The following equations are solved in the controller 26′ for predicting the number of slices, N*a*, for a given package, providing the reset signal at the terminal 50, and providing the feed signal $Vf_n$ at the terminal 52.

$$Vl = K(Wd/Nd) \tag{10}$$

where equation (10) is identical to equation (1) with all symbols retaining their previous definition.

$$E = Wp(|N|/Np) - Wd \tag{11}$$

where equation (11) is the same as equation (6) except that $|N|$ is used in place of N*a*, with all symbols retaining their previous definition.

$$Vf_n = Vl \tag{15}$$

where feed velocity $Vf_n$ is fixed at the initial feed velocity *Vl* according to equation (10).

Generally, the allowable legal underweight L for an individual package is no more than 10 percent of the desired package weight. If, for example, a package is to weigh 16 ounces, then the legal underweight limit L could be no more than −1.6 ounce for a given package. In the description to follow, it is assumed that L is equal to −1.6 ounce; however, it is to be appreciated that other values of L may be used in the practice of the present invention. The estimated value of $|N|$ appearing on the line 90 is calculated in an identical manner as in the controller 26 of FIG. 2. The error signal E appearing on the line 156 is calculated in a similar manner as the like signal set forth in FIG. 2, with the exception that $|N|$ is used in place of *Na*.

The error signal E appearing on line 156 is applied to a first input line 210 of a subtractor 212 and a first input line 214 of a comparator 216. The subtractor 212 has applied to a second input line 218 the ratio signal W*p*/N*p* from the inverting device 84. The difference signal appearing on the output line 220 from the subtractor 212 is the difference between the error signal E and the ratio signal $Wp/Np$. This difference signal is applied to a first input line 222 of a comparator 224 for comparison with the legal underweight reference signal L. The reference signal L is provided to a second input line 226 of comparator 224 and to a second input 230 of the comparator 216 from a read-only memory 228. A gating signal is provided on an output line 232 whenever L is greater than or equal to E. This occurs when E is equal to or more negative than −1.6 indicating equation (12) is satisfied. A gating signal is provided on an output line 234 whenever L is less than or equal to the error quantity $(E-Wp/Np)$. It is seen that the ratio $Wp/Np$ is the average slice weight at any given time during the slicing cycle. Accordingly, if one slice less than the predicted number of slices $|N|$ is sliced, the actual error the system sees is the error quantity. Therefore, if the error quantity is −1.6 or more positive, one slice less than predicted may be sliced and the instant package is within the legal underweight limit. It is understood that $Wp/Np$ is a variable; however, if one assumes that $Wp/Np$ is equal to one, then equation (13) is satisfied when E is equal to or more positive than −0.6. Therefore, again assuming $Wp/Np$ is equal to one, equation (14) is satisfied when E is in the range of −1.5 to −0.7. A subtractor 236 has the signal $|N|$ applied to a first input line 238 and has a signal indicative of a constant 1 applied to a second input line 240 from a read-only memory 242. Appearing on an output line 244 from the subtractor 236 is a signal indicative of the quantity $|N|-1$. An adder 246 has $|N|$ applied to a first input line 248 and a signal indicative of a constant 1 applied to a second input line 250 from a read-only memory 252, with a signal indicative of the quantity $|N|+1$ being manifested on the output line 251. Whenever a gating signal is provided on the line 232, the signal indicative of the quantity $|N|+1$ appearing on line 251 is passed by the AND gate 252 to an output line 253 indicating that equation (12) is satisfied. Whenever a gating signal is provided on the line 234, the signal indicative of the quantity $|N|-1$ appearing on the line 244 is passed by an AND gate 254 to an output line 255 indicating that equation (13) is satisfied. Whenever there is the absence of a gating signal on the lines 232 and 234, there are gating signals provided on output lines 256 and 258 of gates 260 and 262, respectively, which is indicative that equations (12) and (13) are not satisfied. An AND gate 264 is enabled and the signal $|N|$ is passed to an output line 257, which indicates that equation (14) is satisfied. It is seen that the signal $Na$ appearing at terminal 265 and which is applied to the first input terminal 134 of the comparator 136 may be equal to the estimated value of $|N|$ or be equal to $|N| \pm 1$, depending on which of equations (12), (13) or (14) is satisfied.

As was the case for the controller 26, the comparator 136 provides a reset pulse at the terminal 50 whenever $Np$ is greater than or equal to $Na$ for ending one slice cycle. Also, the inverter 208 provides a gating signal on an output line 266, during the times the reset signal isn't provided, for enabling the gate 206 to pass the initial velocity signal, $Vl$, as the feed velocity signal, $Vf_n$, to the output terminal 52. The initial feed velocity signal, $Vl$, is derived identically as in the controller 26, and accordingly its derivation is not repeated.

In summary, a slicing control system has been disclosed for obtaining N slices of substantially uniform thickness from a solid to provide a batch having a desired weight, where N is an integer which may have a value between predefined limits. A partial batch weight is taken in response to weighing a number of slices less than N. A terminal value of N is estimated on the basis of the number of slices in the partial batch, and the ratio of the desired batch weight and the partial batch weight. A predicted terminal deviation from the desired batch weight is calculated based on the partial batch weight and the ratio of the estimated value of N and the number of slices in the partial batch. In one embodiment, the feed rate of the solid into a slicing device, and accordingly the slice thickness and terminal batch weight, is controlled as a function of the value of the predicted terminal deviation. In another embodiment, the feed rate is fixed and the estimated value of N is modified as a function of the predicted terminal deviation for controlling the terminal batch weight.

What is claimed is:

1. A method of providing a batch of N slices from a solid, where N has a value between predetermined limits, with the total weight of said N slices being substantially equal to a desired batch weight, said method comprising the steps of:

feeding said solid, at a selected velocity, into a slicing device which provides slices of a thickness controlled by the feed velocity;

obtaining a partial batch weight during said feeding by weighing a partial batch of less than N slices;

estimating the value of N based on the number of slices in said partial batch and the ratio of said desired batch weight and said partial batch weight;

calculating a predicted terminal deviation from said desired batch weight based on said partial batch weight and the ratio of the estimated value of N and the number of slices in said partial batch; and adjusting the feed velocity of said solid into said slicing device as a function of the value of said predicted terminal deviation.

2. The method of claim 1, including the step of:

modifying the estimated value of N as a function of said predicted terminal deviation.

3. A method of providing a batch of N slices from a solid, where N has a value within predetermined limits, with each individual slice being substantially uniform in thickness and the total weight of said N slices being substantially equal to a desired batch weight, said method comprising the steps of:

feeding said solid, beginning at an initial velocity into a slicing device which provides slices of a thickness controlled by the feed velocity;

obtaining a partial batch weight during said feeding by weighing a partial batch of less than N slices;

estimating the terminal value of N based on the number of slices in said partial batch and the ratio of said desired batch weight and said partial batch weight;

calculating a predicted terminal deviation from said desired batch weight based on said partial batch weight and the ratio of the estimated terminal value of N and the number of slices in said partial batch; and adjusting the feed velocity of said solid into said slicing device based on the ratio of said predicted terminal deviation and the difference between the estimated terminal value of N and the number of slices in said partial batch.

4. The method of claim 3 including the step of:

indicating that a batch of N slices is complete in response to comparing the number of slices in said partial batch with the estimated terminal value of N.

5. A method of providing a batch of N slices from a solid, where N is an integer which has a value between and including a low limit N*l* and a high limit N*h*, with each individual slice being substantially uniform in thickness and the total weight of said N slices being substantially equal to a desired batch weight, said method comprising the steps of:

feeding said solid, beginning at an initial velocity based on the ratio of a desired batch weight and a desired number of slices for the batch, into a slicing device which provides slices of a thickness controlled by the feed velocity;

obtaining a partial batch weight during said feeding by weighing a partial batch of less than N slices;

estimating the terminal value of N based on the number of slices in said partial batch and the ratio of said desired batch weight and said partial batch weight;

determining an actual terminal value for N in response to comparing the estimated value of N with N*l* and N*h*;

calculating a predicted terminal deviation from said desired batch weight based on said partial batch weight and the ratio of the determined actual terminal value of N and the number of slices in said partial batch; and adjusting the feed velocity of said solid into said slicing device based on the ratio of said predicted terminal deviation and the difference between the detemined actual terminal value of N and the number of slices in said partial batch.

6. The method of claim 5 including the step of:

comparing the number of slices in said partial batch with the determined actual terminal value of N for determining when a batch is complete.

7. A method of providing a batch of N slices from a solid, where N has a value between predetermined limits, with the total weight of said N slices being substantially equal to a desired batch weight, said method comprising the steps of:

feeding said solid, at a selected velocity, into a slicing device which provides slices of a thickness controlled by the feed velocity;

obtaining a partial batch weight during said feeding by weighing a partial batch of less than N slices;

estimating the value of N based on the number of slices in said partial batch and the ratio of said desired batch weight and said partial batch weight;

calculating a predicted terminal deviation from said desired batch weight based on said partial batch weight and the ratio of the predicted value of N and the number of slices in said partial batch;

providing an acceptable weight deviation reference; and modifying the estimated value of N based on said predicted terminal deviation and said acceptable weight deviation reference.

8. A method of providing a batch of N slices from a solid, where N has a value between predetermined limits, with the total weight of said N slices being substantially equal to a desired batch weight, said method comprising the steps of:

feeding said solid, at a selected velocity, into a slicing device which provides slices of a thickness controlled by the feed velocity;

obtaining a partial batch weight during said feeding by weighing a partial batch of less than N slices;

estimating the value of N based on the number of slices in said partial batch and the ratio of said desired batch weight and said partial batch weight;

calculating a predicted terminal deviation from said desired batch weight based on said partial batch weight and the ratio of the predicted value of N and the number of slices in said partial batch;

providing an acceptable weight deviation reference, and comparing said predicted terminal deviation with said acceptable weight deviation for modifying the estimated value of N.

9. In a solid slicing control system for providing a batch of N slices from said solid, where N has a value between predefined limits, with the total weight of said N slices being substantially equal to a desired batch weight, the combination comprising:

means for feeding said solid, at a selected velocity, into a slicing device which provides slices of a thickness controlled by the feed velocity;

means for weighing a partial batch of less than N slices during said feeding for obtaining a partial batch weight;

means for estimating the value of N based on the number of slices in said partial batch and the ratio of said desired batch weight and said partial batch weight;

means for calculating a predicted termial deviation from said desired batch weight based on said partial batch weight and the ratio batch; and means for controlling the feed velocity of said solid into said slicing device as a function of the value of said predicted terminal deviation.

10. The combination claimed in claim 9, including:

means for modifying the estimated value of N as a function of said predicted terminal deviation.

11. The combination claimed in claim 9, wherein said means for controlling the velocity of said solid into said slicing device is based on the ratio of the predicted terminal deviation and the difference between the predicted value of N and the number of slices in said partial batch.

12. The combination claimed in claim 11 including:

means for comparing the number of slices in said partial batch with the predicted value of N for determining when a batch is complete.

13. In a solid slicing control system for providing a batch of N slices from said solid, where N is an integer which has a value between and including a low limit N*l* and a high limit N*h*, with each individual slice being substantially uniform in thickness and the total weight of said N slices being substantially equal to a desired batch weight, the combination comprising:

feeding means for feeding said solid, beginning at an initial velocity based on the ratio of said desired batch weight and a desired number of slices for said batch, into a slicing device which provides slices of a thickness controlled by the feed velocity;

weighing means for weighing a partial batch of less than N slices during said feeding for obtaining a partial batch weight;

estimating means for estimating the terminal value of N based on the product of the number of slices in said partial batch with the ratio of said desired batch weight and said partial batch weight;

means for determining the actual terminal value for N in response to comparing the estimated terminal value of N with N*l* and N*h;* calculating means for calculating a predicted terminal deviation from said desired batch weight based on said partial batch weight and the ratio of the determined actual terminal value of N and the number of slices in said partial batch; and means for adjusting the feed velocity of said solid into said slicing device in response to taking the ratio of said predicted terminal deviation and the calculated difference between the determined actual value of N and the number of slices in said partial batch.

14. The combination claimed in claim 13 including:

comparison means for comparing the number of slices in said partial batch with the determined actual terminal value of N for determining when a batch is complete.

15. In a solid slicing control system for providing a batch of N slices from said solid, where N has a value between predefined limits, with the total weight of said N slices being substantially equal to a desired batch weight, the combination comprising:

means for feeding said solid, at a selected velocity, into a slicing device which provides slices of a thickness controlled by the feed velocity;

means for weighing a partial batch of less than N slices during said feeding for obtaining a partial batch weight;

means for estimating the value of N based on the number of slices in said partial batch and the ratio of said desired batch weight and said partial batch weight;

means for calculating a predicted terminal deviation from said desired batch weight based on said partial batch weight and the ratio of the predicted value of N and the number of slices in said partial batch;

means for providing an acceptable weight deviation reference; and means for modifying the estimated value of N based on said predicted terminal deviation and said acceptable weight deviation reference.

16. In a solid slicing control system for providing a batch of N slices from said solid, where N has a value between predefined limits, with the total weight of said N slices being substantially equal to a desired batch weight, the combination comprising:

means for feeding said solid, at a selected velocity, into a slicing device which provides slices of a thickness controlled by the feed velocity;

means for weighing a partial batch of less than N slices during said feeding for obtaining a partial batch weight;

means for estimating the value of N based on the number of slices in said batch and the ratio of said desired batch weight and said partial batch weight;

means for calculating a predicted terminal deviation from said desired batch weight based on said partial batch weight and the ratio fo the predicted value of N and the number of slices in said partial batch;

means for providing an acceptable weight deviation reference; and means for comparing said predicted terminal deviation with said acceptable weight deviation for modifying the estimated value of N.

* * * * *